United States Patent [19]

Chinman

[11] Patent Number: 4,881,684

[45] Date of Patent: Nov. 21, 1989

[54] WRAPPER FOR ARTICLES WITH IMPROVED SECURING ARRANGEMENT

[76] Inventor: Carole Chinman, 922 Blackshire Rd., Wilmington, Del. 19805

[21] Appl. No.: 214,008

[22] Filed: Jun. 30, 1988

[51] Int. Cl.[4] ..... B65D 65/10; A45F 5/10

[52] U.S. Cl. ..... 229/87 A; 190/117; 190/902; 229/87 R; 294/150; 294/152; 294/157

[58] Field of Search ..... 229/87 A, 87 R, 77, 229/84; 150/52 R; 190/26, 27, 115, 117, 106, 107, 902; 383/18, 12, 15; 294/138, 147, 150, 152, 155, 157, 162

[56] References Cited

U.S. PATENT DOCUMENTS

| | | | |
|---|---|---|---|
| 230,772 | 8/1880 | Hefely | 206/380 |
| 712,137 | 10/1902 | Jackson | 294/157 X |
| 726,119 | 4/1903 | Trognitz | 294/138 |
| 841,902 | 1/1907 | Shumard | 150/52 R |
| 1,385,695 | 7/1921 | MacCormack et al. | 150/52 R |
| 1,861,974 | 6/1932 | Ottinger | 190/902 X |
| 1,877,954 | 9/1932 | Ottinger | 190/902 X |
| 1,920,586 | 8/1933 | Ottinger | 190/902 X |
| 2,443,702 | 6/1948 | Bruning | 229/77 |
| 3,024,824 | 3/1962 | Bass | 150/52 R |
| 3,315,857 | 4/1967 | Eclov | 294/157 X |
| 3,623,526 | 11/1971 | Robertson | 150/52 R |
| 3,923,222 | 12/1975 | Groves | 383/18 X |
| 3,957,099 | 5/1976 | Kery | 150/52 R X |
| 4,506,769 | 3/1985 | Franco et al. | 190/115 X |
| 4,562,952 | 1/1986 | Chinman | 229/874 |
| 4,700,818 | 10/1987 | Orwin | 190/27 |

*Primary Examiner*—Bryon P. Gehman

*Attorney, Agent, or Firm*—Connolly & Hutz

[57] ABSTRACT

A wrapper includes a flexible member having a reinforced central area and a plurality of wing sections which extend outwardly from the central area. The wing sections are foldable over the reinforced portion of the central area in overlapping relationship with each other to form a closed container for articles placed therein. Fasteners maintain the wing sections or flaps in a folded condition. The fasteners include a securing member which secures the lower flap and side flaps or wing sections together to form an envelope of adjustable thickness and which is open at its top side. The fasteners further selectively secures the upper flap to the remaining flaps to close the envelope whereby the wrapper functions as an adjustable briefcase. Various strap assemblies are provided which are used with the wrapper.

31 Claims, 4 Drawing Sheets

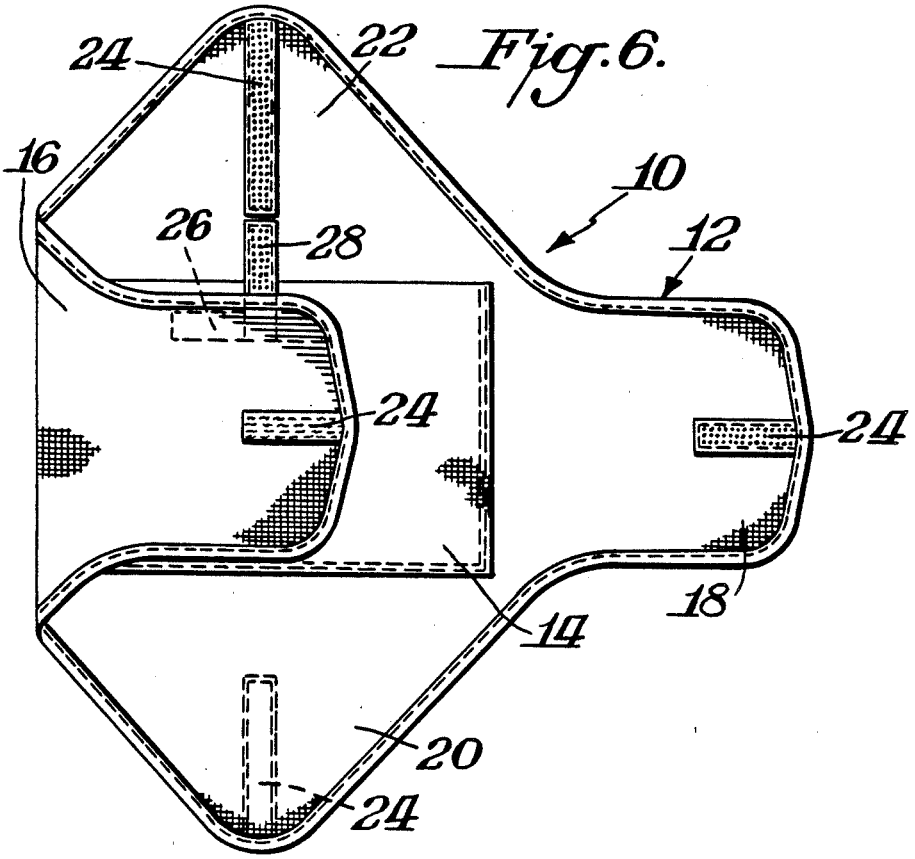
Fig. 6.
Fig. 7.
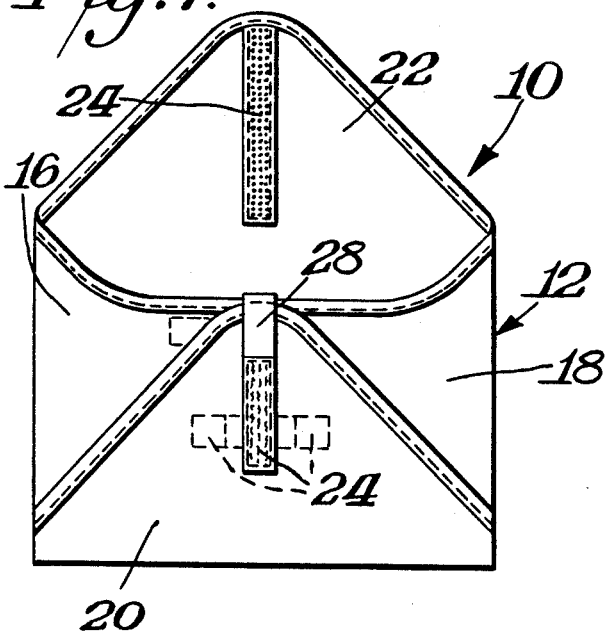

WRAPPER FOR ARTICLES WITH IMPROVED SECURING ARRANGEMENT

BACKGROUND OF THE INVENTION

In my U.S. Pat. No. 4,562,952 I disclosed a wrapper for clothing which includes a reinforced central area and a plurality of wing sections. When used for clothing the wrapper also includes a rigid shape retainer which is used to assure that the clothing is properly folded and of a size conforming to the reinforced portion of the central area. The stiffener would also be maintained in the wrapper to provide further stability when using the wrapper for clothing.

While the wrapper of my above patent is not necessarily limited to being used for clothing it does have particular utility for that purpose. It would be desirable if modifications could be made to that wrapper which particularly lends itself for use as a briefcase for holding other articles, such as papers, books and the like. Additionally, it would be desirable if means could be provided to assist in holding the wrapper rather than requiring the user to physically grasp the wrapper itself.

SUMMARY OF THE INVENTION

An object of this invention is to provide a wrapper of the type disclosed in my U.S. Pat. No. 4,562,952 which is also usable as a briefcase.

A further object of this invention is to provide straps which may be detachably associated with the wrapper to facilitate carrying the wrapper.

In accordance with this invention, a wrapper of the type disclosed in my U.S. Pat. No. 4,562,952 is modified to include a securing strip which maintains the lower flap and side flaps secured together so as to form an envelope which is open at its top side. In this manner, the open top side would provide ready access to the interior of the wrapper. After articles have been placed in the wrapper the top flap could then be secured to the remaining flaps so that a briefcase is thus formed which is adjustable in thickness, thereby still maintaining the advantages of my prior wrapper.

In accordance with a further aspect of this invention, a strap assembly is provided which facilitates the ready carrying of the wrapper by means of various straps which fit around the wrapper and loops which may be held by the user or which may extend over the user's shoulder. In a variation the straps may be such that the wrapper can be carried in the form of a knapsack.

THE DRAWINGS

FIGS. 6 and 7 show the wrapper of FIGS. 1–3 at various stages of assembly;

DETAILED DESCRIPTION

Figure 1:
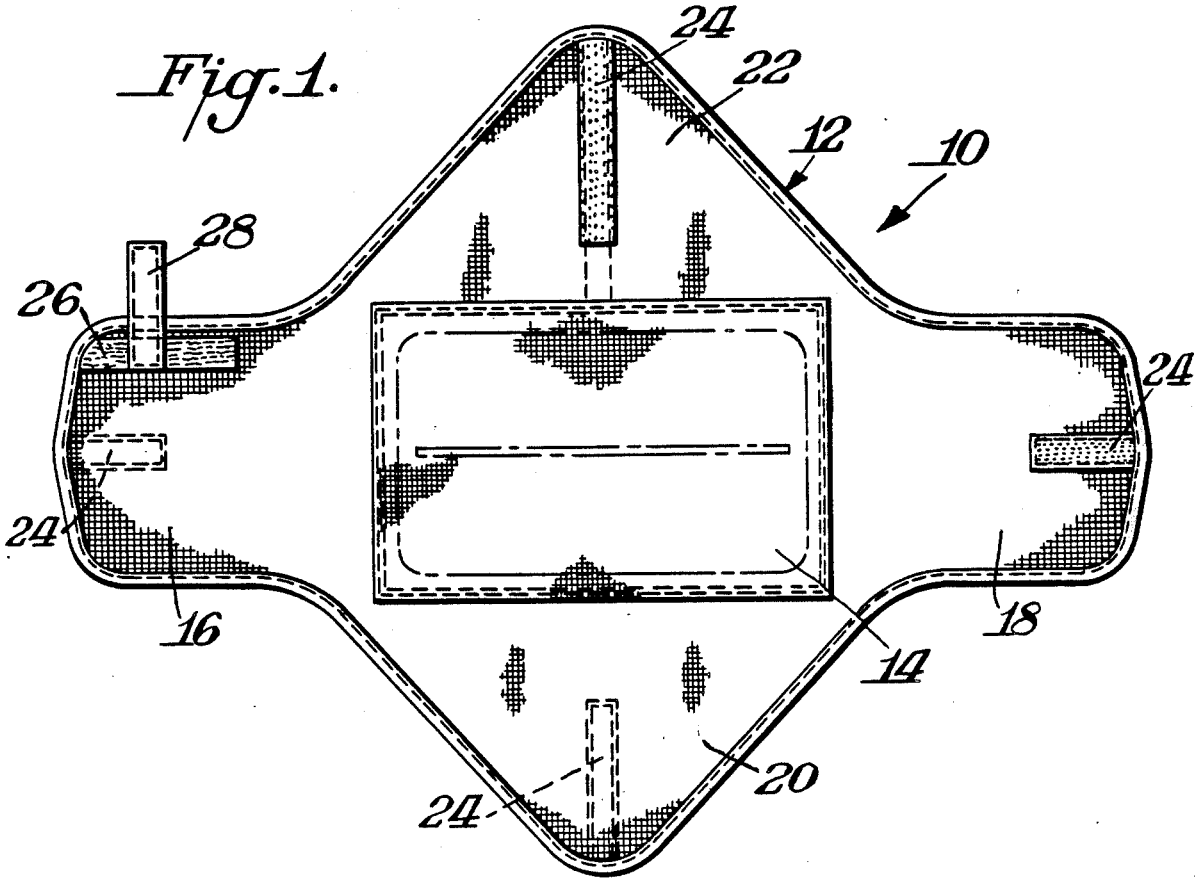
FIG. 1 is a front elevation view of a wrapper in its unfolded condition in accordance with this invention.
Figure 2:
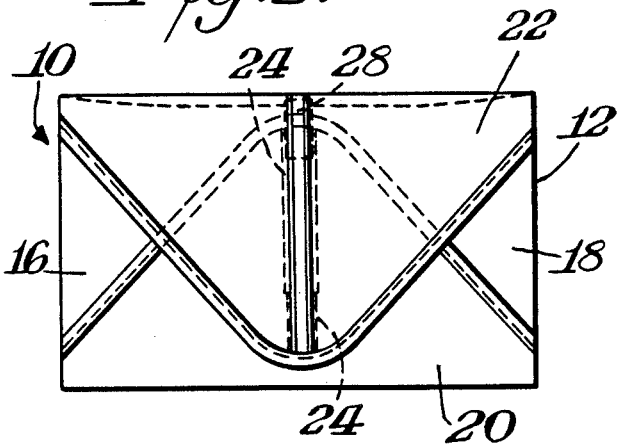
FIG. 2 is a front elevation view of the wrapper of FIG. 1 in its closed condition.

FIGS. 1–7 show a wrapper 10 in accordance with this invention. As indicated therein, wrapper 10 includes a flexible member 12 which has a reinforced central area 14 and a plurality of wing sections 16, 18, 20, 22. Wing sections 16 and 18 may be considered side flaps, while wing section 20 is a lower flap and wing section 22 is an upper flap. Each flap is defined by opposed faces. Fastening means in the form of various Velcro strips 24 are provided for the straps or wing sections in the manner of my U.S. Pat. No. 4,562,952, the details of which are incorporated herein by reference thereto.

FIG. 6 shows the first step in assembly of wrapper 10 as a wrapper for articles. As indicated therein, side flap 16 is folded upon central section 14. Next, the other side flap 18 would be folded upon side flap 16 and engaged thereto by the velcro strips 24,24 contacting each other.

As shown in FIG. 7 the next step would be to fold lower flap 20 upon the folded side flaps 16,18 thus creating an envelope which is open at its top sides.

In accordance with this invention a further securing member 26 which is preferably in the form of a permanent velcro strip is provided on the face of flap 16 opposite its fastening strip 24. Thus, when the various flaps are in their folded condition, Velcro strip 26 would be on the inner most surface of the folded flaps. An additional detachable securing strip 28 which likewise is preferably Velcro is provided so as to engage strip 26 and then be bent over the folded sides and lower flaps and then engage Velcro strip 24 of lower flap 20 to hold these three flaps in their folded condition, as shown in FIG. 7. Advantageously, the resultant structure can effectively function as a briefcase having an open top side which is selectively closed by simply folding upper flap 22 so that its fastening strip 24 engages the remaining exposed portion of fastening strap 24 on lower flap 20 to assume the condition shown in FIG. 2.

Figure 3:
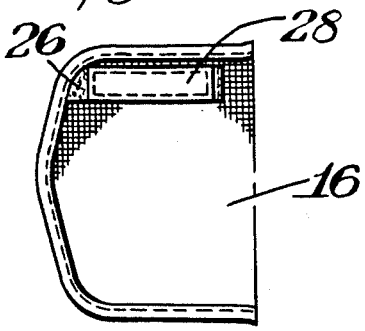
FIG. 3 is a front elevation view of a portion of the wrapper shown in FIGS. 1–2.

The arrangement described herein is particularly advantageous in that strip 28 may be held by strip 26 (FIG. 3) when wrapper 10 is used as a clothing wrapper as in my above indicated patent, rather than as a briefcase where it is not necessary to secure the lower and side flaps together in the manner of Figure 7. Thus, Velcro strip 26 serves the dual function of providing a means for securing the various flaps together by its engagement with strip 28 when the wrapper is in the condition shown in Figure 7 and the additional function of providing a means for holding strip 28 during conditions where the wrapper does not function as a briefcase as shown in FIG. 3.

Each Velcro strip 24 includes either hooks or loops. The strips are arranged so that the exposed strips are those having the loops so as to avoid snagging.

Figure 4:
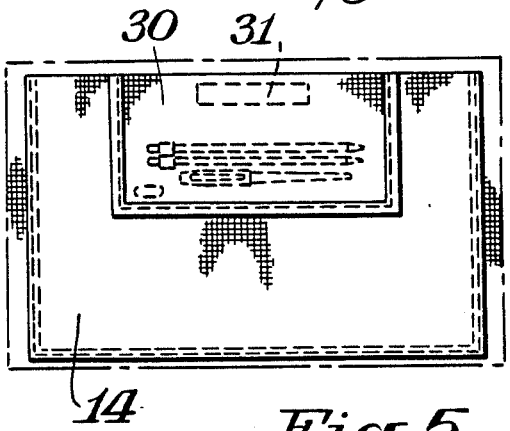
FIG. 4 is a front elevation view of a modified form of wrapper in accordance with this invention.

If desired the invention may also be practiced by providing a pocket 30 on the inner surface of the resulting envelope, such as by securing the pocket 30 to the same face of flap 16 which has Velcro strip 26. Pocket 30 could be utilized for holding small objects, such as pencils and the like as illustrated in FIG. 4. Pocket 30 could be closed by pressing the outer layer against Velcro strip 31.

Figure 5:
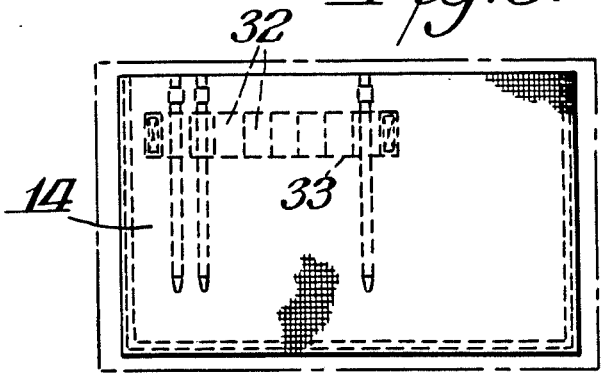
FIG. 5 is a front elevation view of yet another modified form of wrapper in accordance with this invention.
Figure 8:
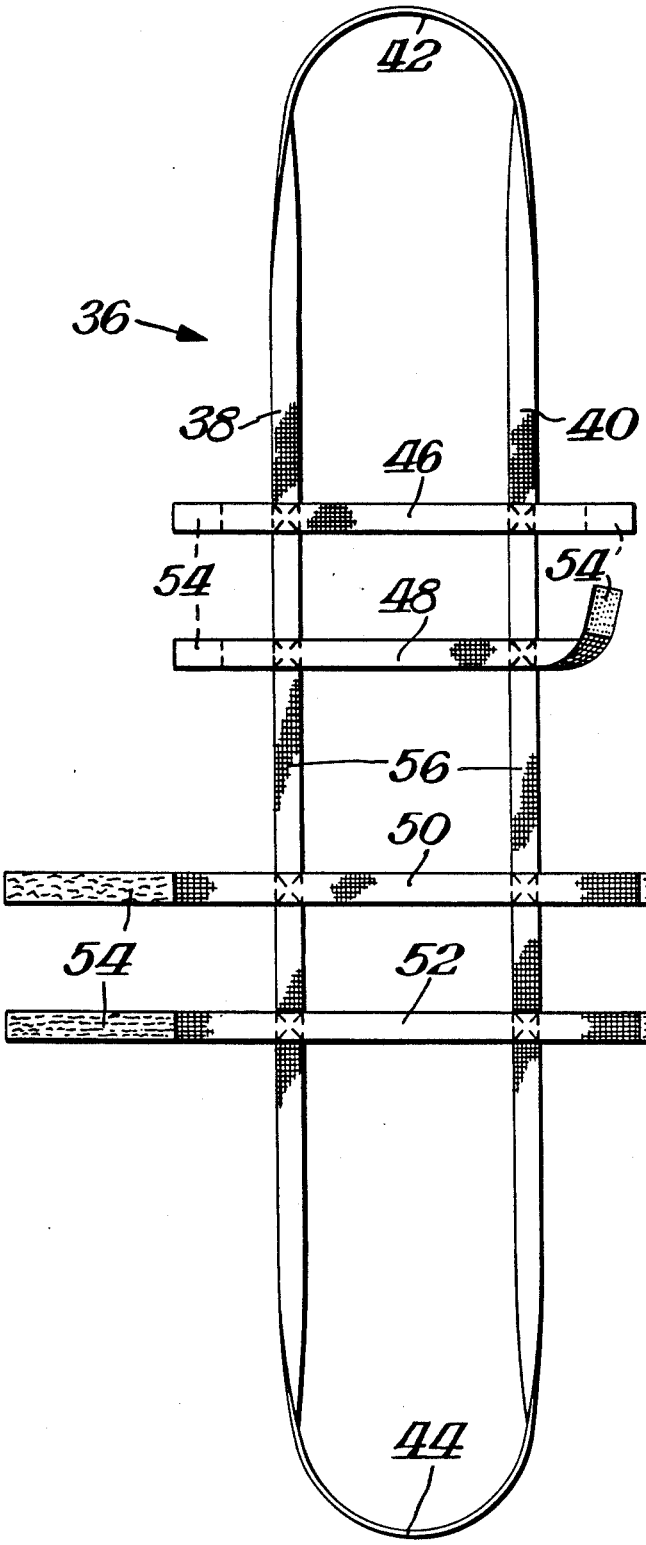
FIG. 8 is a front elevation view of a strap assembly usable with the wrappers of FIGS. 1–7.

A variation of pocket 30 would be the provision of other means for holding small items, such as loops 32 illustrated in FIG. 5. Advantageously, the loops are formed by stitching strip 33 at various spaced locations.

Wrapper 10 is particularly advantageous since it can function as a briefcase and yet be lighter than conventional briefcase made of materials such as leather or vinyl. In addition, because wrapper 10 has no solid frame, it would not bump uncomfortably against the body as is a disadvantage with conventional briefcases. Moreover, wrapper 10 would thus be easier to carry. Wrapper 10 can easily be opened by simply disengaging upper flap 22 from the assembled remaining flaps so that wrapper 10 assumes the condition shown in FIG. 7. Wrapper 10 advantageously is capable of holding such items as papers so they do not wrinkle by telescoping. Where wrapper 10 is made of portfolio size, it can hold art work which would not wrinkle and can more easily be stacked since it would be in a completely flat condition in wrapper 10. A distinct advantage that wrapper 10 affords over conventional briefcase, however, is that its size or thickness is adjustable to conform to the volume of the articles placed therein. Thus, the briefcase of wrapper 10 would only be as bulky as the contents required therefore providing for a briefcase which is easier and more convenient to carry. If desired, the stiffener described in my above indicated patent may be used in wrapper 10 to sandwich the articles, particularly paper items between the stiffener and the reinforced central area.

FIGS. 8-14 illustrate a particularly advantageous aspect of this invention which relates to the provision of a strap assembly particularly adapted for use with a wrapper, such as wrapper 10 or the wrapper of my prior patent.

Figure 9:
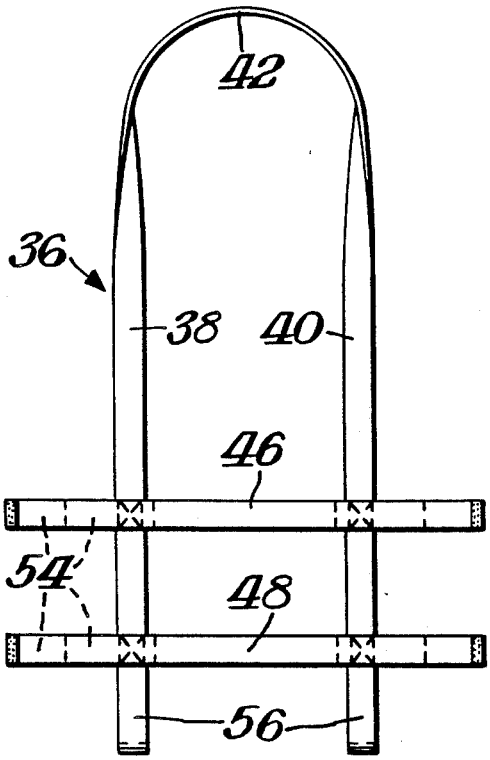
FIG. 9 is a front elevation view of the strap assembly of FIG. 8 in its folded condition.
Figure 10:
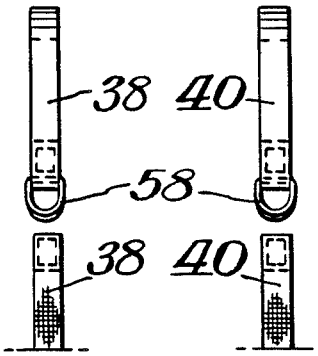
FIG. 10 is a front elevation view of a modified form of a strap assembly in accordance with this invention.
Figure 11:
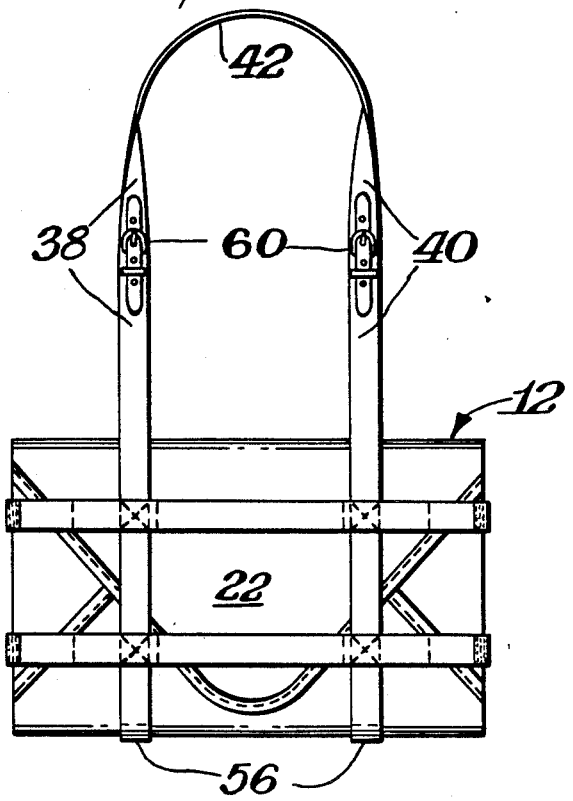
FIG. 11 is a front elevation view of the strap assembly of FIGS. 8–10 in slightly modified form in combination with a wrapper, such as the wrappers of FIGS. 1–7.
Figure 12:
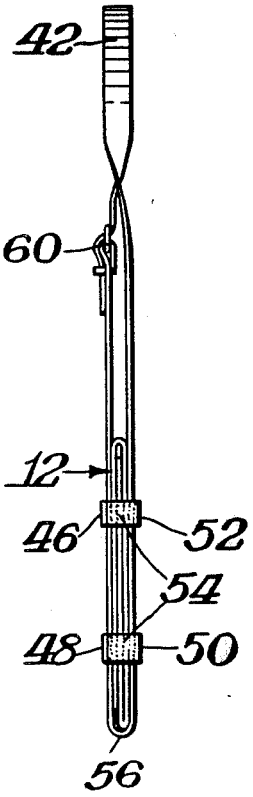
FIG. 12 is a side elevation view of the wrapper and strap assembly combination of FIG. 11.

FIGS. 8-12 illustrate one form of strap assembly 36. As shown therein a pair of main straps 38,40 are provided which are interconnected at their ends 42,44 to form an oval shaped endless belt. Sets of side straps 46, 48 and 50, 52 extend across main straps 38,40. The free ends of the side straps are provided with adjustable fastening means, such as Velcro portions 54. In use, main straps 38, 40 would be folded at a location 56 centrally between the two sets of side straps, so as to form a cradle at the bent portion, as illustrated in Figure 9. In this bent condition, strap 46 would be aligned with strap 52 and strap 48 would be aligned with strap 50. The Velcro portions of the various aligned straps would be engaged so as to form two sets of closed loops, one loop comprising strap 46 being engaged with strap 52 and the other comprising strap 48 being engaged with strap 50. Wrapper 10 would then be inserted in the loops between the two sets of side straps and would rest upon the cradle portions 56 as illustrated in FIGS. 11-12. Ends 42 and 44 would function as loops which could be placed over the user's shoulder or could be held as handles for readily carrying wrapper 10.

It is to be understood that although the invention has been described with respect to Velcro strips as the adjustable fastening means for the side straps, other types of fasteners may be used such as those later described with the main straps. For example D-rings or buckles would be particularly appropriate where the side straps are made of leather.

The strap assembly 36 is particularly advantageous in that it utilizes adjustable wrappers. Additionally, in accordance with this invention, it is possible to provide adjustability in the length of main straps 38,40. FIG. 10, for example illustrates D-rings 58 being provided in an arrangement where each strap 38 and 40 is made of separate pieces the total length of which can be adjusted by its engagement with the D-rings 58.

Figure 14:
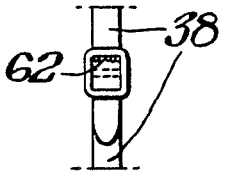
FIG. 14 is a front elevation view of a portion of a modified strap assembly in accordance with this invention.

FIG. 11 illustrates a variation wherein a conventional buckle type arrangement 60 is utilized to provide for length adjustability. FIG. 14 illustrates a variation which utilizes a tooth buckle 62.

In the preferred practice of this invention, the Velcro strips 54 on side straps 46,48 are provided with the hook portions while the loop portions of the Velcro strips 54 are on straps 50,52. This results in the smooth surface of the velcro strips being exposed rather than the hooked surface.

The utilization of strap assembly 36 with wrapper 10 is particularly advantageous because, as shown in FIG. 11, top flap 22 is readily accessible and the wrapper may be opened by lifting top flap 22 without the necessity of removing the wrapper from the strap assembly or without the necessity of otherwise disassembling parts of wrapper 10.

It is to be understood that the invention is not limited to fabric type materials for wrapper 10 particularly when used in combination with a strap assembly. Rather other materials, such as vinyl or leather may be used, while still taking advantage of the strap assembly.

Additionally, the combination of strap assembly 36 and wrapper 10 has the added advantage of permitting objects such as umbrellas or newspapers to then be slipped between the straps and the wrapper and securely held in place.

The combination of strap assembly and wrapper is particularly advantageous because the straps fit tightly around the contents by adjusting to the volume inside. Since the straps are adjustable, they may also be customized for different individuals. Moreover, by providing straps to hold or carry the wrapper, the user has free hands to engage in other activities such as walking, carrying other items, bicycling or hiking. When wrapper 10 is used for a heavy load, strap assembly 36 provides the advantage of permitting the load to be supported on the shoulders which would be easier than by carrying by hand. As previously indicated, the combination of strap assembly and wrapper permits the wrapper to be easily opened so that the contents are readily accessible and visible, and thus easily available as when waiting or standing in line.

Figure 13:
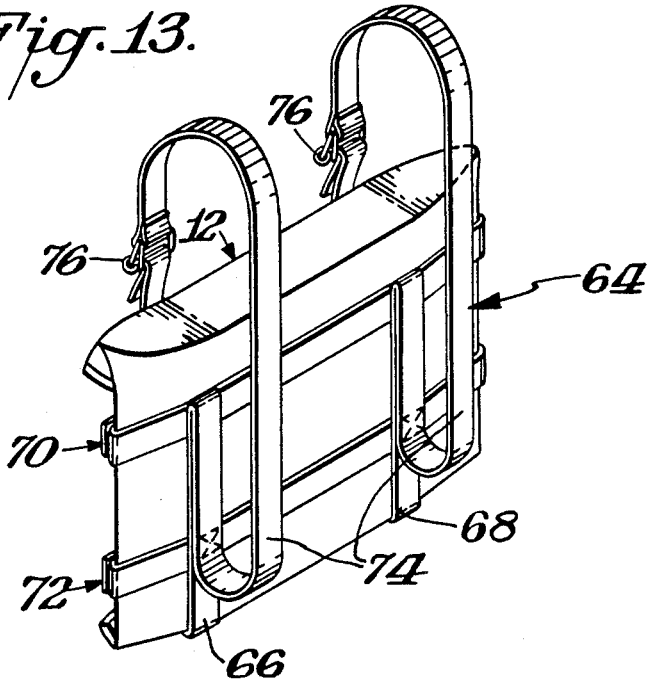
FIG. 13 is a perspective view of a modified form of strap assembly with a wrapper in accordance with this invention.

FIG. 13 illustrates a variation of strap assembly in accordance with this invention. As shown therein strap assembly 64 is in the form of a knapsack or backpack. In this regard, strap assembly 64 includes main straps 66,68 with the sets of side straps 70,72. The side straps would be secured together in the manner previously described regarding strap assembly 36. Main straps 68, however, are individual straps. For example, the main straps may terminate at each end at side straps 70 rather than being a continuous oval shaped strap as in the prior embodiment. Each main strap is provided with a loop 74 which extends on the one side from side straps 70 down to side straps 72 and then loops over to the other side where it is connected to side strap 70. Alternatively, each main strap 66, 68 may in itself be an endless loop secured for stability purposes to the various side straps as illustrated in FIG. 13. The result in either version, however, is in the provision of a loop 74 which extends partially down one side and extends over to the other side so that that wrapper may be carried in knapsack from in the manner of a backpack. Thus, both arms of the user are free. As with strap assembly 36, length adjustability would be provided by any suitable fasteners such as D-ring closures 76.

The combination of strap assembly and wrapper thus utilizes all of the advantages with the wrapper in my prior patent while adding additional advantages including the ability to use the wrapper as a briefcase and the ability to carry the wrapper in a manner which frees the user's hands.

What is claimed is:

1. In a wrapper for articles wherein a flexible member has a reinforced central area and a plurality of wing sections extending outwardly from the central area, the wing sections being foldable over the reinforced portion of the central area in overlapping relation with each other to form a closed container for articles placed therein, the wing sections comprising a lower flap and an upper flap and a pair of intermediate side flaps, each flap having opposing faces, fastening means on each of the flaps for maintaining the flaps in a folded condition when said fastening means is in the closed condition of said wrapper, the improvement being in that said fastening means including adjustable securing means for securing said lower flap and said side flaps together to form an envelope of adjustable thickness which is open at its top side, said fastening means selectively securing said upper flap to the remaining flaps to close said envelope whereby said wrapper functions as an adjustable briefcase, said securing means including a permanent securing strip permanently mounted on one of said side flaps on a face of said side flap opposite its face having its fastening means, and a detachable securing strip selectively mounted to said permanent securing strip during periods of non-use and mounted to said permanent securing strip and to said fastening means on one of said flaps other than said upper flap and said side flap having said permanent securing strip.

2. The wrapper of claim 1 wherein each of said securing strips is a Velcro strip.

3. The wrapper of claim 2 wherein said fastening means on said upper flap is a Velcro strip which extends over said detachable securing strip and is detachably attached to said fastening means of said lower flap.

4. The wrapper of claim 3 including a pocket within said envelope secured to an upper portion of the innermost flap.

5. The wrapper of claim 4 including locking means for maintaining said pocket closed.

6. The wrapper of claim 3 including article holding means within said envelope secured to an upper portion of the innermost flap for securing articles to said innermost flap.

7. The wrapper of claim 6 wherein said holding means comprises a holding strip secured to said innermost flap, and said strip having a plurality of loops.

8. The wrapper of claim 1 including a pocket within said envelope secured to an upper portion of the innermost flap, and said pocket being mounted completely to said innermost flap.

9. The wrapper of claim 8 including locking means for maintaining said pocket closed.

10. The wrapper of claim 1 including article holding means within said envelope secured to an upper portion of the innermost flap for securing articles to said innermost flap.

11. The wrapper of claim 10 wherein said holding means comprises a holding strip secured to said innermost flap, and said strip having a plurality of loops.

12. The wrapper of claim 1, in combination therewith, a detachable strap assembly comprising a pair of main straps, a plurality of sets of side straps secured to and extending across said main straps with said side straps having free ends, attaching means securing said free ends of said side straps of one of said sets to said free ends of said side straps in the other of said sets when said main straps are folded at a location intermediate said sets of side straps to form a cradle in the area where said main straps are folded, said wrapper resting upon said cradle, and said main straps having loop means which comprise handles for carrying said wrapper.

13. The combination of claim 12 wherein said pair of main straps are interconnected to form an endless oval, and the interconnected main straps forming said loop means which may selectively comprise handles and shoulder loops.

14. The combination of claim 13 wherein the length of said main straps is adjustable.

15. The combination of claim 14 wherein said attaching means comprise Velcro strips.

16. The combination of claim 15 wherein one of said sets of side straps is longer than the other of said sets of side straps, and a strap from one of said sets being aligned with and connected to a corresponding strap in said other of said sets.

17. The combination of claim 12 wherein said loop means is formed by said main straps extending partially down one side of said wrapper and over to the other side whereby said strap assembly functions as a back pack.

18. The combination of claim 17 wherein the length of said main straps is adjustable.

19. The combination of claim 18 wherein said attaching means comprise Velcro strips.

20. The combination of claim 19 wherein one of said sets of side straps is longer than the other of said sets of side straps, and a strap from one of said sets being aligned with and connected to a corresponding strap in said other of said sets.

21. The combination of claim 12 wherein said upper flap is accessible to provide access to said envelope without removing said wrapper from said strap assembly.

22. In a wrapper of adjustable thickness for articles wherein a flexible member has a reinforced central area and a plurality of wing sections extending outwardly from the central area, the wing sections being foldable over the reinforced portion of the central area in overlapping relation with each other to form a closed container for articles placed therein, the wing sections comprising a lower flap and an upper flap and a pair of intermediate side flaps, fastening means on each of the flaps maintaining the flaps in a folded condition, the closed container having front and rear faces and intermediate end walls, the improvement being in combination therewith, a detachable strap assembly comprising a pair of main straps, a plurality of sets of side straps secured to and centrally extending across said main straps with said side straps having free ends, each of said side straps of one of said sets being longer than said each of said side straps of the other of said sets, attaching means adjustably securing said free ends of said side straps of one of said sets to said free ends of said side straps in the other of said sets to form a closed loop of adjustable length when said main straps are folded at a location intermediate said sets of side straps to form a cradle in the area where said main straps are folded, said container resting upon said cradle, said attaching means securing aligned pairs of said free ends of said side straps together at one of said faces of said container in accordance with the thickness of said container and said main straps having loop means which comprise handles for carrying said container.

23. The combination of claim 22 wherein said pair of main straps are interconnected to form an endless oval, and the interconnected main straps forming said loop means which may selectively comprise handles and shoulder loops.

24. The combination of claim 23 wherein the length of said main straps is adjustable.

25. The combination of claim 24 wherein said attaching means comprise Velcro strips.

26. The combination of claim 26 wherein each of said sets of side straps includes two side straps, a strap from one of said sets being aligned with and connected to a corresponding strap in said other of said sets near the bottom of said container, and the other straps of said sets being connecting near the top of said container.

27. The combination of claim 22 wherein said loop means comprises a loop from each of said main straps extending partially down one side of said container and over to the other side whereby said strap assembly functions as a back pack.

28. The combination of claim 27 wherein the length of said main straps is adjustable.

29. The combination of claim 28 wherein said attaching means comprise Velcro strips.

30. The combination of claim 29 wherein each of said sets of side straps includes two side straps, a strap from one of said sets being aligned with and connected to a corresponding strap in said other of said sets near the bottom of said container, and the other straps of said sets being connected near the top of said container.

31. The combination of claim 22 wherein each of said sets of side straps includes two side straps, a strap from one of said sets being aligned with and connected to a corresponding strap in the other of said sets near the bottom of said container, and the other straps of said sets being connected near the top of said container.

* * * * *